US007678244B2

(12) United States Patent
Despinasse et al.

(10) Patent No.: US 7,678,244 B2
(45) Date of Patent: Mar. 16, 2010

(54) ELECTROLYTIC CELL LEAK LIMITER

(75) Inventors: Serge Despinasse, L'Echaillon (FR); Alain Fernandez De Grado, Genech (FR); Patrick Delescluse, Cysoing (FR)

(73) Assignees: Aluminum Pechiney (FR); E.C.L. (FR)

( * ) Notice: Subject to any disclaimer, the term of this patent is extended or adjusted under 35 U.S.C. 154(b) by 1207 days.

(21) Appl. No.: 11/052,755

(22) Filed: Feb. 9, 2005

(65) Prior Publication Data

US 2005/0194249 A1 Sep. 8, 2005

Related U.S. Application Data

(63) Continuation of application No. PCT/FR02/03513, filed on Oct. 14, 2002.

(51) Int. Cl.
*C25B 9/00* (2006.01)
*C25C 3/08* (2006.01)
*C25C 3/06* (2006.01)

(52) U.S. Cl. ..... 204/242; 204/196.2; 204/196.33; 204/286.1

(58) Field of Classification Search ..... 204/242, 204/196.2, 196.33, 286.1
See application file for complete search history.

(56) References Cited

U.S. PATENT DOCUMENTS

| | | | | |
|---|---|---|---|---|
| 3,093,369 | A | 6/1963 | Duclaux | |
| 3,627,670 | A | 12/1971 | Duclaux | |
| 3,888,757 | A | 6/1975 | Roukema et al | |
| 3,919,071 | A | 11/1975 | Mosé | |
| 4,406,767 | A * | 9/1983 | Fischer | 204/247 |
| 4,464,243 | A * | 8/1984 | Woolhouse | 204/257 |
| 5,128,012 | A | 7/1992 | Olsen | |
| 5,378,338 | A | 1/1995 | Langon et al. | |
| 5,876,585 | A | 3/1999 | Schenk | |

FOREIGN PATENT DOCUMENTS

| | | |
|---|---|---|
| AU | S-154066 | 12/2003 |
| AU | S-154067 | 12/2003 |
| DE | 10117116 | 10/2002 |
| EP | 0178766 | 4/1986 |
| FR | 1437465 | 7/1966 |
| FR | 2039543 | 1/1971 |
| RU | 2 1 86 883 C2 | 8/2002 |
| WO | WO 94/12696 | 6/1994 |

(Continued)

OTHER PUBLICATIONS

Tomago Aluminum News, Issue No. 1, Mar. 2003.

*Primary Examiner*—Harry Wilkins
*Assistant Examiner*—Zulmariam Mendez
(74) *Attorney, Agent, or Firm*—Banner & Witcoff, Ltd.

(57) ABSTRACT

The purpose of this invention is a leak limiter (20) of an electrolytic cell (1) for the production of aluminum, fitted with confinement means comprising passage openings for the insertion of anode stems (3), characterized in that it comprises at least one support (21), capable of surrounding all or part of an anode stem, and at least one flexible sealing body (30, 30*a*, 30*b*, 30*c*) arranged around all or part of the periphery (23) of the support (21) and designed to close off all or some of the free space between the inside edge of an opening and an anode stem (3). This invention improves the leak tightness of covering means used in electrolytic cells.

33 Claims, 8 Drawing Sheets

FOREIGN PATENT DOCUMENTS

| | | |
|---|---|---|
| WO | WO 95/22640 | 8/1995 |
| WO | WO 01/12881 | 2/2001 |
| WO | WO-2004/035872 | 4/2004 |
| WO | WO-2004/101853 | 11/2004 |
| WO | WO-2005/009685 | 2/2005 |

* cited by examiner

ELECTROLYTIC CELL LEAK LIMITER

CROSS-REFERENCE TO RELATED APPLICATION

The present application is a continuation of International Application No. PCT/FR2002/003513 filed Oct. 14, 2002, the content of which is incorporated herein by reference in its entirety.

BACKGROUND OF THE INVENTION

1. Field of the Invention

The invention relates to the production of aluminum by igneous electrolysis. More particularly, the present invention relates to means of confining gaseous effluents produced during electrolysis.

2. Description of Related Art

Metal aluminum is produced industrially by igneous electrolysis, namely by electrolysis of alumina in solution in a molten cryolite bath called an electrolyte bath, using the well-known "Hall-Héroult Process." The electrolyte bath is contained in pots called "electrolytic pots", comprising a steel pot shell lined on the inside with refractory and/or insulating materials, and a cathode assembly located at the bottom of the pot. Anodes made of a carbonaceous material are partially immersed in the electrolyte bath. The assembly including an electrolytic pot, its anodes and the electrolyte bath is typically referrer to as an electrolytic cell.

The electrolysis reaction, secondary reactions and high operating temperatures cause the production of gaseous effluents that, in particular, comprise carbon dioxide and products containing fluorine. Release of these effluents into the atmosphere is severely controlled and governed by strict regulations, firstly for the ambient atmosphere in the electrolysis room in consideration of the working conditions of personnel close to the cells, and secondly for atmospheric pollution. Regulations in several countries and states impose pollution limits on effluent quantities released into the atmosphere.

At the moment, solutions for extracting, recuperating and treating these effluents in a reliable and satisfactory manner have been proposed. One widespread solution involves providing the electrolytic cells with an effluent collection device. This device covers the electrolytic pots and comprises confinement means that in particular include a covering device, as well as a means of suction and chemical treatment of the effluents. Known processes for the treatment of effluents include particularly recuperation of gases containing fluorine by reaction with alumina. The covering device comprises access means such as hoods, usually removable, and a tapping door used to work on the pot.

The covering device delimits a confined suction area at a negative pressure relative to the ambient atmosphere, so that effluents can be recovered efficiently. The result is that collection efficiencies under steady state conditions sometimes exceed 97% in most modern industrial installations, such that release of gaseous products containing fluorine into the atmosphere are significantly lower than regulatory limits.

In general, anodes are connected to an electric power supply bar located outside the collection device through metallic stems that pass through the device by openings formed therein. The free space (or "clearance") left by stems in these openings is not sealed, to enable vertical and horizontal displacements of the metallic stems. Vertical displacements are frequent, and in particular, compensate for wear of anodes during electrolysis. Horizontal displacements generally occur during operations to replace used anodes.

Free spaces between anode stems and the inside edge of passage openings form a confinement break that while being relatively insignificant for each individual anode stem, becomes significant when considering all anodes in a pot, and even more significant for a series of several hundred cells.

SUMMARY OF THE INVENTION

An object of the present invention was to provide a leak limiter capable of reducing the confinement break originating from openings to allow anode stems to pass through. More precisely, a leak limiter according to the present invention was designed to limit air and gas passages between the inside and outside of the collection device in an igneous electrolysis aluminum production cell through an anode stem passage opening.

An advantageous leak limiter in an electrolytic cell according to the present invention preferably comprises at least one support that is capable of surrounding at least a portion of an anode stem, and at least one flexible sealing body arranged around at least a portion of a periphery of the support, wherein the leak limiter is designed to close off at least a portion of free space between an inside edge of an anode stem opening and the anode stem.

A flexible body of the present invention preferably provides a certain degree of leak tightness around the anode stem and this leak tightness can be maintained due to the flexibility of the body, despite inevitable variations in the position of the stem. In particular, the invention significantly limits gaseous exchanges or gas leakage through the free space.

The support is advantageously in the form of a notch to simplify construction of the leak limiter and to enable lateral insertion of an anode stem through the headwall opening.

Another object of the present invention is the provision of an electrolytic cell comprising at least one leak limiter according to the invention.

Additional objects, features and advantages of the invention will be set forth in the description which follows, and in part, will be obvious from the description, or may be learned by practice of the invention. The objects, features and advantages of the invention may be realized and obtained by means of the instrumentalities and combination particularly pointed out in the appended claims.

BRIEF DESCRIPTION OF THE DRAWINGS

The invention will be better understood after reading the detailed description of a preferred embodiment of it as described below, illustrated with reference to the attached figures.

DETAILED DESCRIPTION OF A PREFERRED EMBODIMENT

Figure 1:
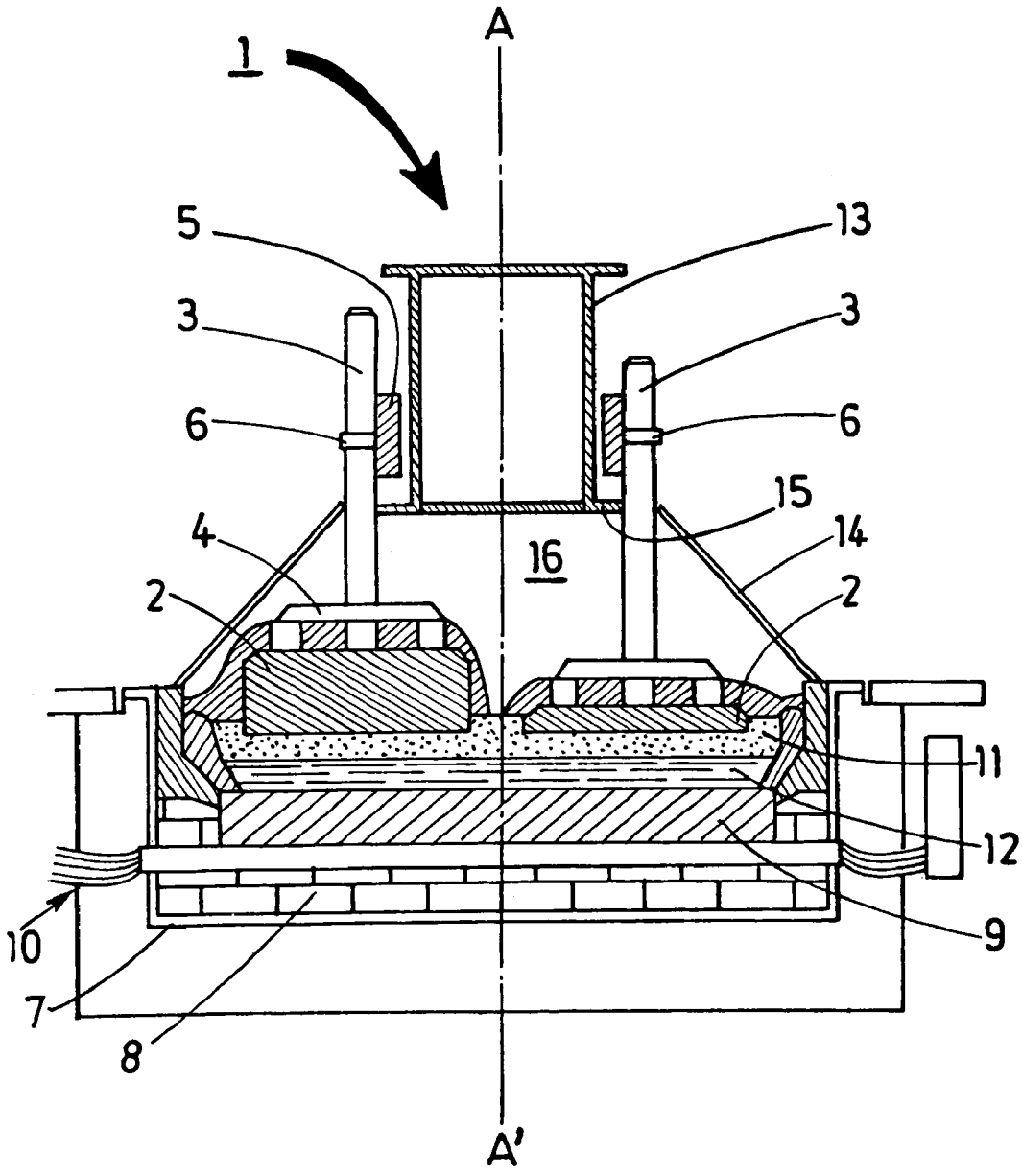
FIG. 1 shows a cross-section of a typical electrolytic cell intended for production of aluminum.

As illustrated in FIG. 1, an electrolytic cell (1) for production of aluminum by the Hall-Héroult process typically comprises a pot (10), anodes (2) supported by attachment means typically including a stem (3) and a multipode (4), and mechanically and electrically connected to an anode frame (5) using connection means (6). Typically, the anode stem (3) has a substantially rectangular and/or square cross-section. The pot (10) comprises a steel pot shell (7), inside lining elements (8) and a cathode assembly (9). The lining elements (8) and the cathode assembly (9) form a crucible inside the pot (10) that contains the electrolyte bath (11) and a liquid metal pad (12).

The electrolytic cell (1) also comprises a metallic structure (13) that in particular supports the anode frame (5) preferably making it free to move, and a device for collecting effluents comprising confinement means (14, 15) and delimiting an internal confined space (16). Typically, the confinement means comprise removable hoods (14) and a fixed hood (15).

Figure 2:
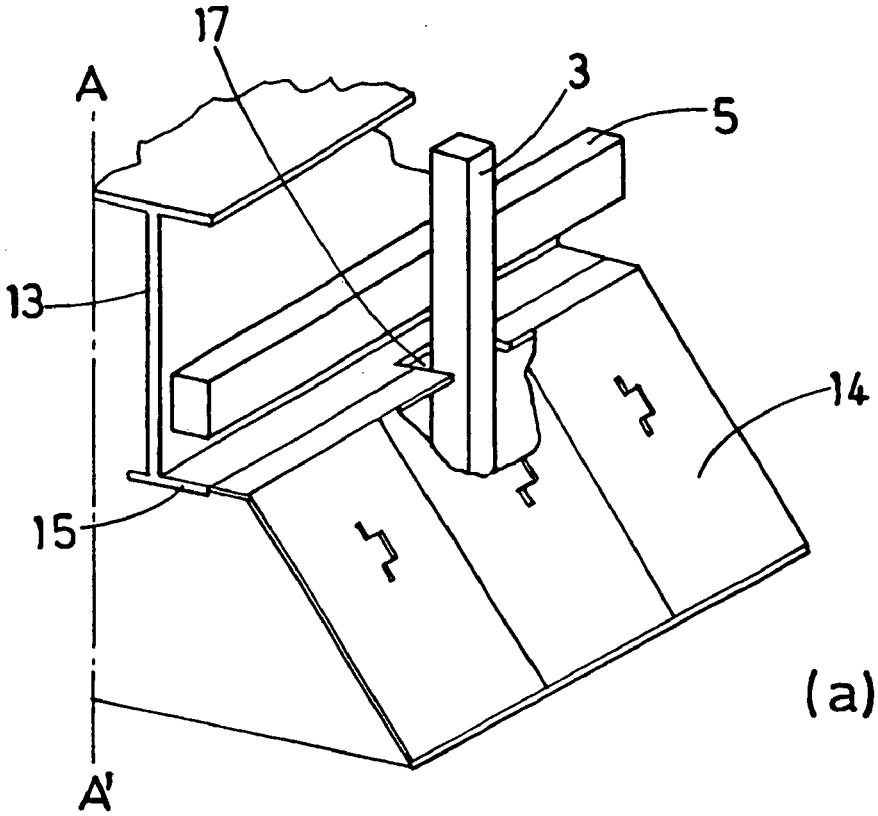
FIG. 2 shows a simplified perspective view of part of a typical electrolytic cell designed for production of aluminum (*a*) without and (*b*) with a leak limiter according to the invention.
Figure 2:
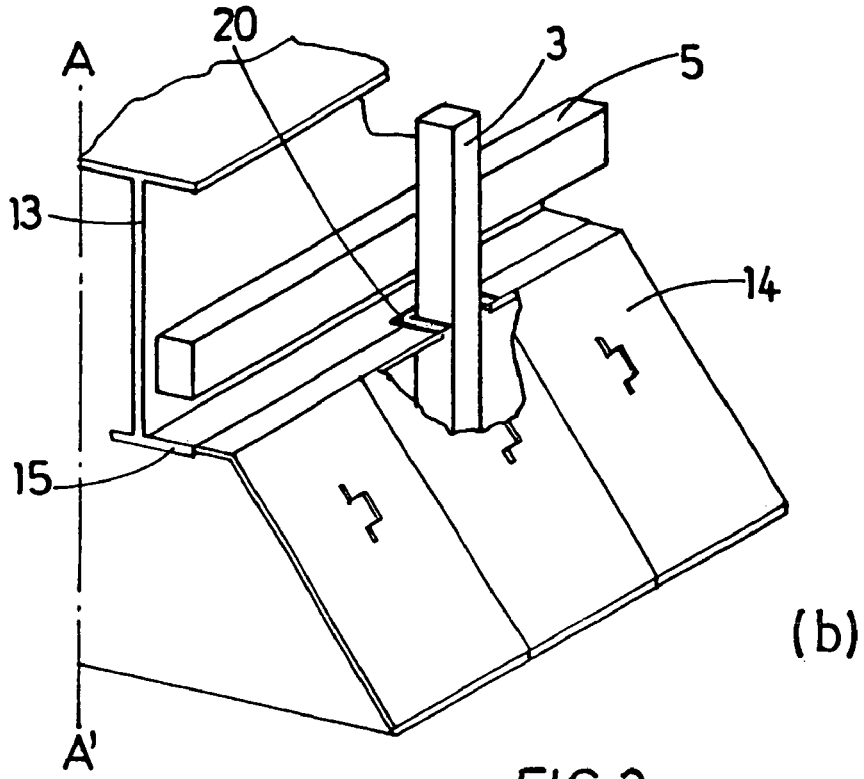

As illustrated for example in FIG. 2(*a*), the collection device comprises openings (17) through which an anode stem (3) can pass freely. This opening is usually in the form of a crenel so that an anode stem can be inserted. The anodes (2) are usually inserted or removed from an electrolytic cell by lateral insertion after removal of one or several hoods (14). Consequently, the opening (17) is such that it enables lateral insertion of the stem (3) of the anode (2), with or without longitudinal displacement of the anode, in other words with or without the anode moving along the main axis of the cell.

FIG. 2(*b*) diagrammatically illustrates the position of the leak limiter (20) according to the invention in the anode passage opening (17).

A leak limiter (20) of an electrolytic cell (1) for the production of aluminum provided with confinement means (14, 15) comprising passage openings (17) for the insertion of anode stems (3), advantageously comprises at least one support (21) capable of surrounding all or part of an anode stem, and at least one flexible sealing body (30, 30*a*, 30*b*, 30*c*) arranged around all or part of the periphery (23) of the support (21) and designed to close off all or some of the free space between the inside edge (18) of an opening (17) and an anode stem (3).

The support (21) may be in any desired shape. Different shapes, such as substantially straight, curved or other shapes are possible. The support (21) may also be made from different elements.

In one advantageous embodiment of the invention, the support(s) (21) form an opening, or "notch", (26), through which an anode stem (3) can be inserted laterally. This is advantageous because such a system permits the anode to be easily accessed when the anode needs to be changed. If lateral insertion were not possible, the leak limiter could not remain fixed when the anode is being changed, thereby complicating anode replacement. Typically, the opening (26) is U-shaped or forms a frame with three sides. The sealing body(ies) (30, 30*a*, 30*b*, 30*c*) are advantageously arranged around an internal periphery (23) of the opening (26).

In this embodiment, the leak limiter (20) preferably surrounds at least three sides of the anode stem (3). The shape of the sealing body (30) may be such that it also covers the fourth side of the stem. The leak limiter (20) may possibly comprise a complementary closing element (20') that may be movable or removable, and is capable of limiting leaks through the fourth side after the stem has been inserted. This complementary closing element (20') may include a support (21') provided with a flexible sealing body (30'). Optionally, this complementary element may be fixed to the fixed hood (15) or to the mobile hood (14) close to the anode stem. The sealing body (30) can comprise a single element or can be comprised of multiple elements. In one embodiment, the sealing body (30) is formed of three elements to facilitate ease in construction and use.

Figure 3:
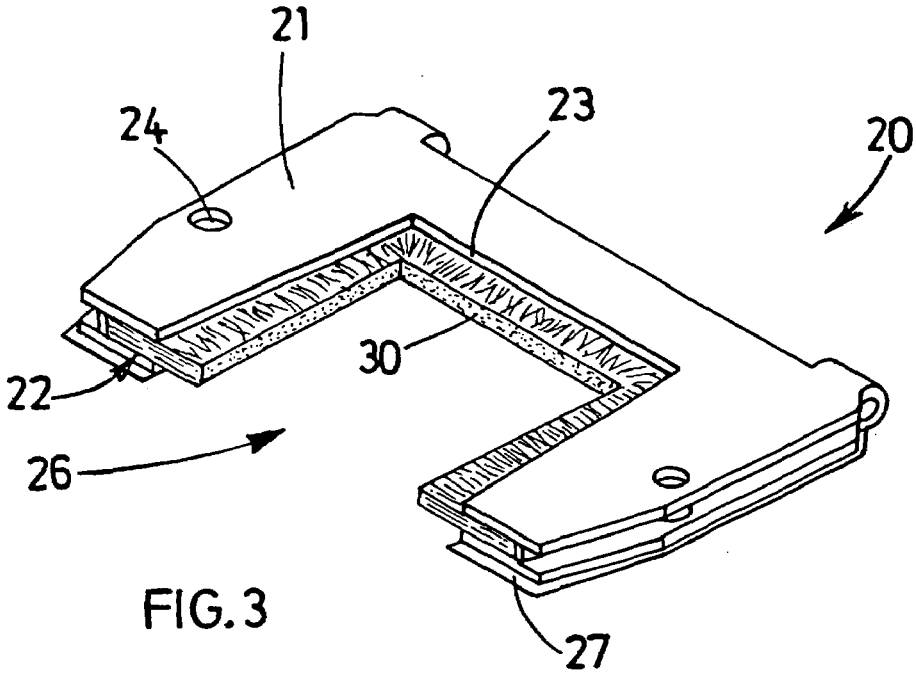
FIGS. 3 to 5 illustrate leak limiters according to the invention.
Figure 4:
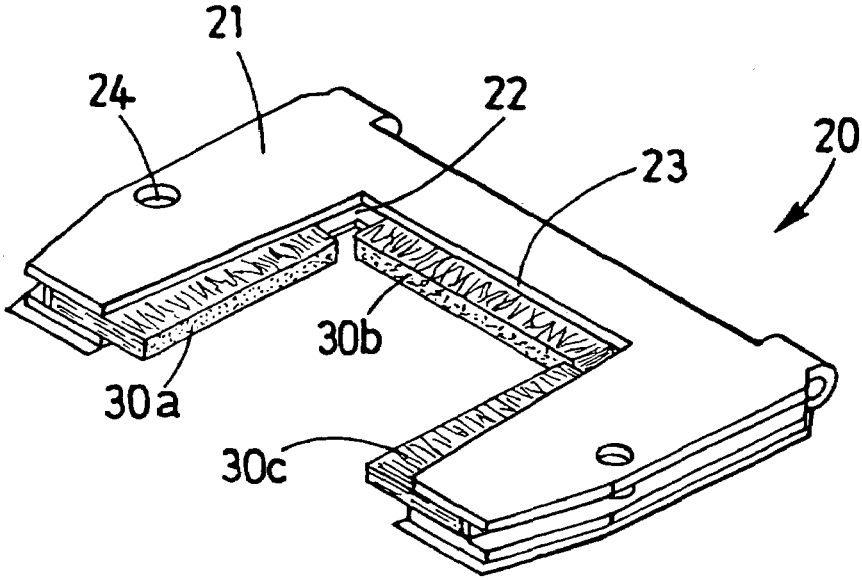

FIG. 3 illustrates a case in which the sealing body is formed from a single element (30). FIG. 4 illustrates the case in which the sealing body is made from three separate adjacent elements (30*a*, 30*b*, 30*c*).

Figure 5:
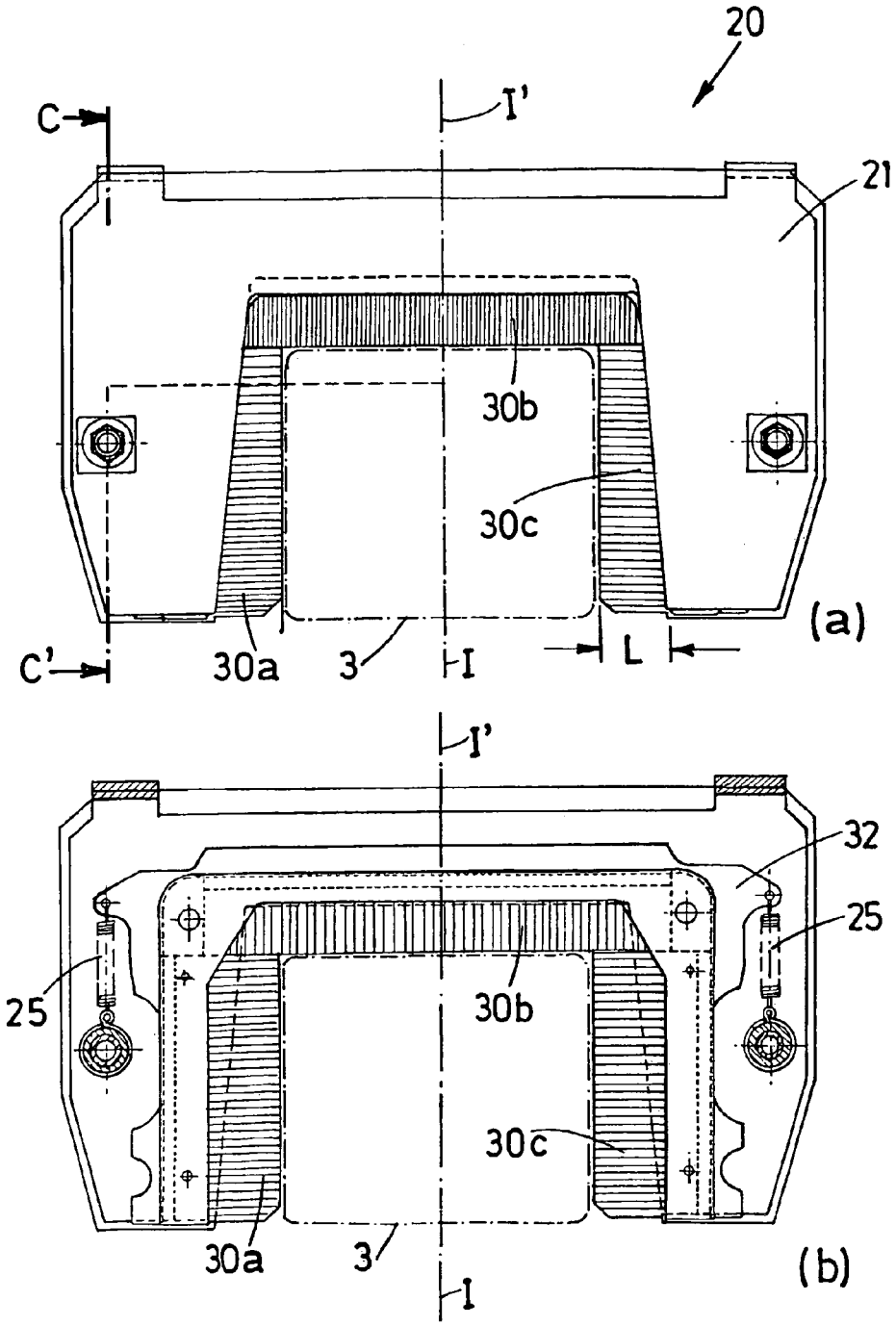

As illustrated in FIG. 5, the sealing body is adjacent to the anode stem, but is not necessarily in contact with it. It may be separated by a few millimeters, typically about 2 or about 3 mm, without significantly reducing the improved leak tightness achieved with the device according to the invention. The fact that the instant leak limiter is flexible, e.g. the anode stem can move sideways slightly as well as move up and down, reduces the likelihood that the leak limiter will break in use. That is, if the leak limiter is tightly mounted, due to the enormous forces it will encounter, it could easily be damaged. Thus, it is advantageous that the leak limiter be in touch with the anode stem as much as possible while still permitting flexibility.

The flexible sealing body may be made of any flexible element capable of efficiently closing off all or some of the said free space. For example, it may suitably be formed of wires, strips, spongy substances or flexible tubes, or any combination of these possibilities. It may be metallic or non-metallic.

The flexible sealing body (30) is preferably capable of resisting the atmosphere in the internal space (16) in an electrolytic cell and maintaining its mechanical properties at temperatures reached in this environment.

Advantageously, the flexible sealing body (30) is formed from a bundle of metallic and/or non-metallic wires. It has been found that the bundle of wires is a means of providing leak tightness around the anode stem due to the density of the wires, and that this leak tightness is maintained due to the flexibility of the wires, despite inevitable variations in the position of the stem. The wires also help to maintain good leak tightness despite surface defects on the anode stem.

The use of stainless steel wires has been found to be advantageous. Sealing bodies made from stainless steel type wire resist mechanical loads applied by the anode stem during its movements efficiently and enable sufficient flexibility.

The wires of the bundle (30) are preferably sufficiently tight to cause a significant loss of pressure between the outside and inside of the collection device. It has been found that a linear density of preferably about 100 to about 1000 wires per centimeter around the periphery is sufficient. The bundle thickness is typically more than preferably about 0.5 cm. The wire diameter typically ranges from preferably about 0.1 to about 1 mm. The aperture angle $\alpha$ of the bundle of metal wires typically ranges from preferably about 0 to about 45°, and more typically between 0 and about 30°. The length L of metallic wires output from the support is typically ranges from preferably about 1 to about 10 cm.

According to one advantageous embodiment of the invention, at least one flexible sealing body (30, 30*a*, 30*b*, 30*c*) is fixed to a second support or "frame" (32) that is free to move with respect to the support (21).

In such an embodiment, the support (21) is typically provided with an elongated opening (22) around its inside periphery (23), and the frame (32) is inserted in order to be free to move in this opening. The frame (32) and the flexible sealing body (30, 30*a*, 30*b*, 30*c*) then form a mobile assembly or "drawer", (31) that improves self-positioning of the sealing means during movements of the anode stem. The frame/sealing body assembly (31) is typically free to move substantially perpendicularly to the anode stem (3).

In this embodiment of the invention, the flexible sealing body (30, 30*a*, 30*b*, 30*c*) and the frame (32) are preferably made of non-magnetic materials to avoid developing a magnetic force in the presence of the intense magnetic field present in the environment of the cell, preventing this magnetic field from stopping the movement. For example, the frame (32) is advantageously made of aluminum or an aluminum alloy, and the wires are preferably made of non-magnetic stainless steel.

The fact that the elements (31) are free to move in the support (21) can facilitate maintenance and replacement of these elements following wear or damage.

The leak limiter (20) preferably also comprises at least one connecting element (25) between the support (21) and each frame (32), in order to help control displacement of the sealing body(ies) (30, 30*a*, 30*b*, 30*c*) with respect to the support (21). The connecting element is typically preferably fixed to the frame (32). At least one connecting element advantageously comprises an elastic element such as a spring or elastic blade, in order to facilitate self-positioning of the brush(es) with respect to the anode stem (3). It may also be possible to use connecting rods and/or guidance means, possibly combined with one or several elastic element(s). It is preferable that two (2) springs and/or elastic blades are employed. It is further advantageous that the each support (21) be of unitary construction and not include multiple pieces. This is because a single unitary construction of the support (21) simplifies the manufacturing thereof.

FIGS. 5 to 8 illustrate a preferred embodiment of the invention in which the sealing body (30, 30*a*, 30*b*, 30*c*) is made of wires fixed to a single mobile frame (32) capable of displacing with respect to the frame (21).

Figure 6:
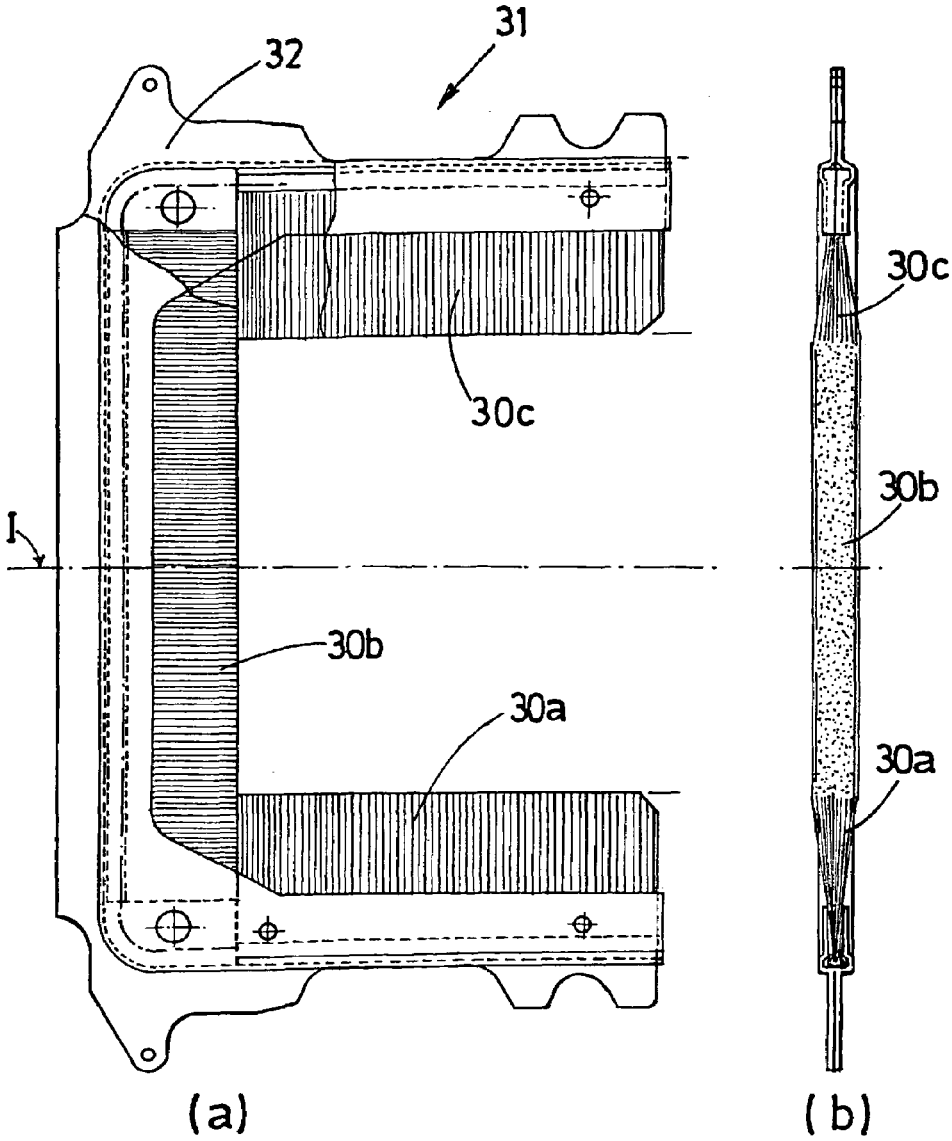
FIG. 6 illustrates the U-shaped brush of a leak limiter according to one variant of the invention.
Figure 7:
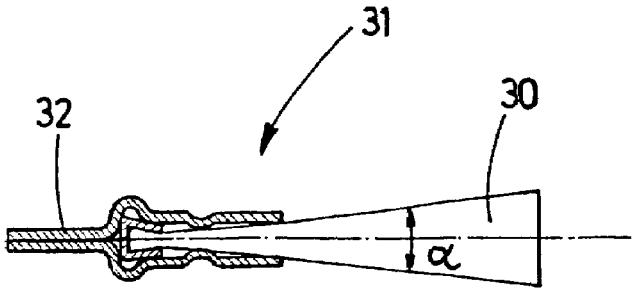
FIG. 7 illustrates a cross-section along the I-axis of the U-brush of the leak limiter illustrated in FIG. 5.
Figure 8:
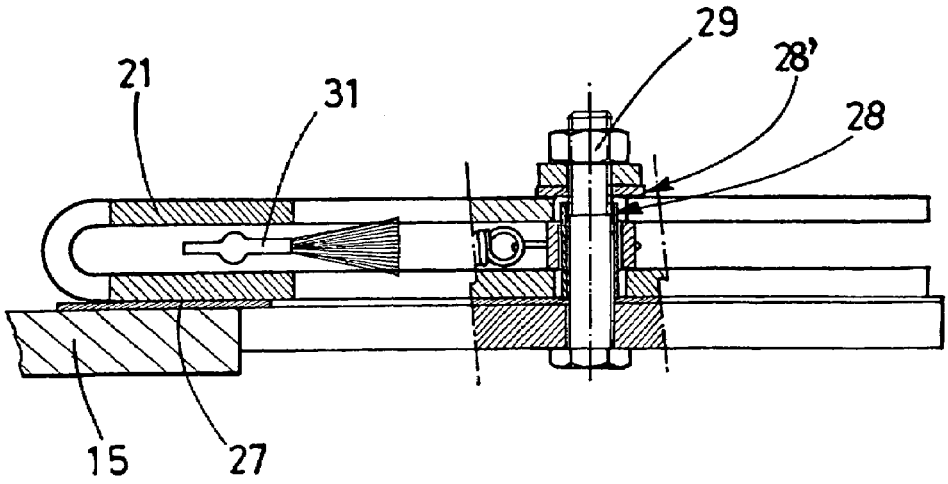
FIG. 8 illustrates sections I' to C' of the leak limiter illustrated in FIG. 5.

FIG. 5(*b*) shows a longitudinal sectional view of the limiter in FIG. 5(*a*) that reveals the frame/wire assembly (31) called a "brush", located partly inside the support (21). The profile of the anode stem (3) is seen in dashed lines. FIG. 6 shows the brush (31) alone, seen in its main plane (*a*) and on its edge (*b*).

Figure 9:
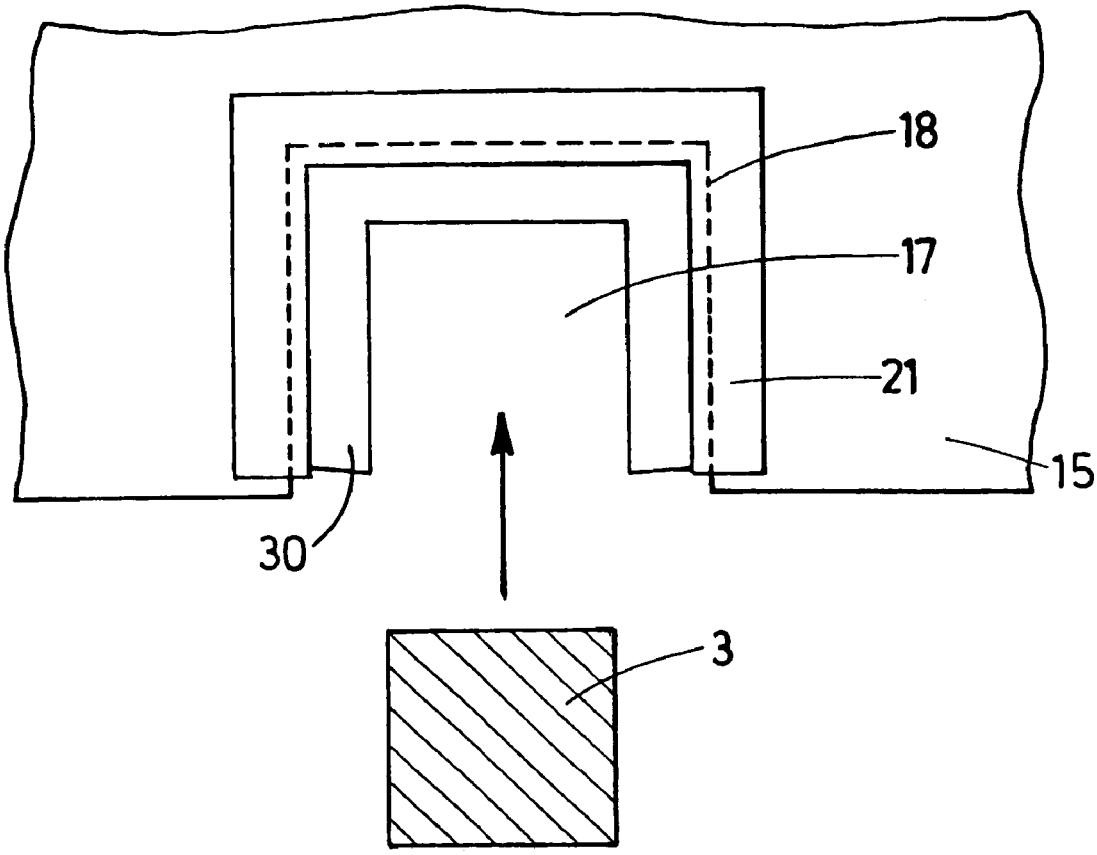
FIGS. 9 and 10 illustrate methods of inserting an anode stem in the leak limiters according to the invention.
Figure 10:
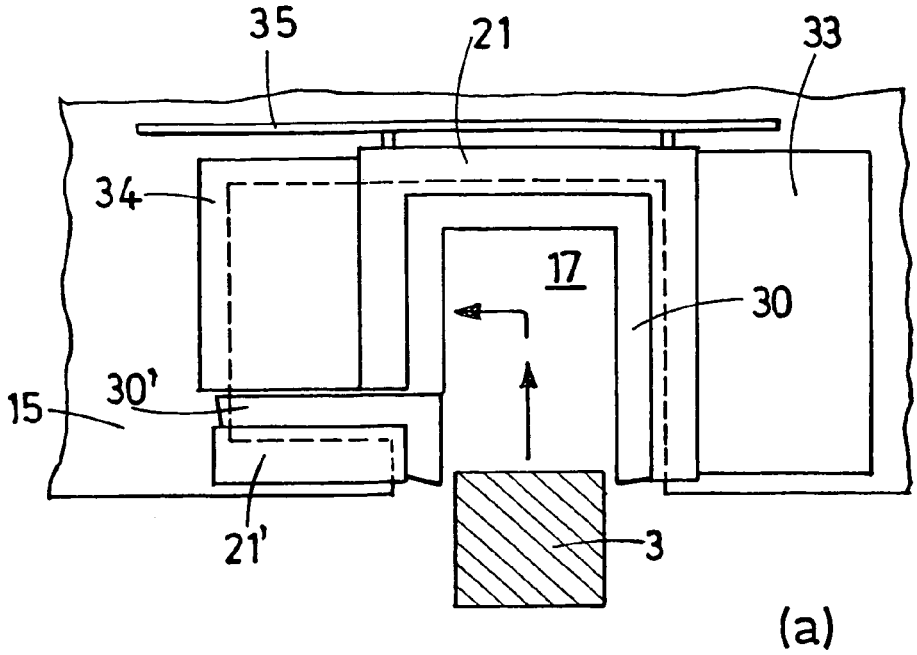
Figure 10:
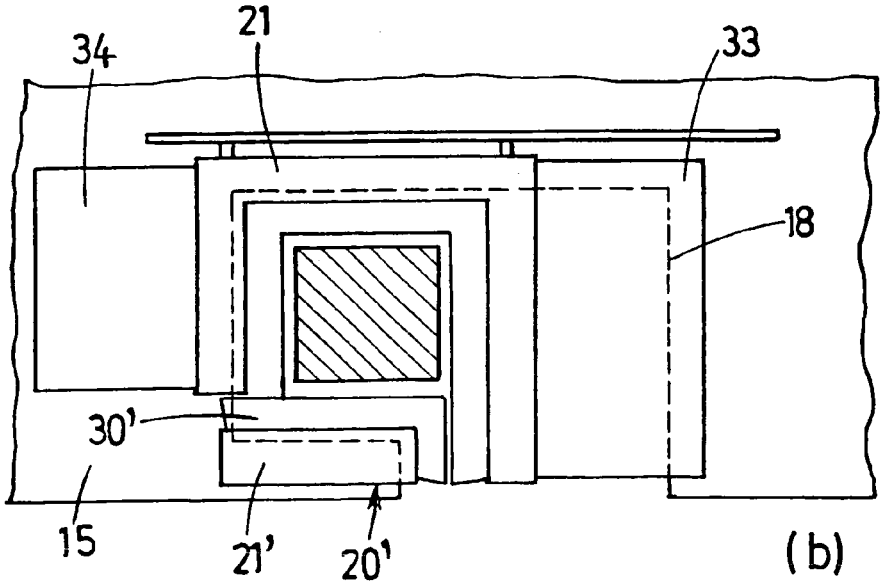

An anode stem (3) is normally inserted laterally along an I-I' axis illustrated in FIGS. 5 and 6. FIGS. 9 and 10 illustrate two methods of inserting an anode stem. FIG. 9 shows the case of a single-directional insertion. FIG. 10 shows the case of a two-directional insertion with movement of the leak limiter with respect to the electrolytic cell.

The support (21) and the frame (32) are typically made of metal in order to provide and/or facilitate sufficient mechanical strength. Aluminum and aluminum alloys are non-magnetic and may be used advantageously. The support (21) can comprise one or more elements as desired. For example, the support (21) can comprise and upper and lower portions that are connected and hence the support is of a single piece. The support (21) can also comprise two elements that are preferably oriented parallel to each other.

The support (21) is advantageously sufficiently stiff so that the leak limiter can resist a force applied by an operator's foot, without damage.

The leak limiter (20) may be fixed to the electrolytic cell, and more precisely to a structural element of the electrolytic cell or to the collection device in any desired way, for example rigidly or freely moveable. For that purpose, the support (21) advantageously comprises means (24) of fixing the support to the electrolytic cell, wherein the means (24) is preferably removable. A removable attachment, for example using bolts and nuts (29), makes it easy to remove the leak limiter without removing the anode.

Although a rigid attachment is sufficient in many cases, a mobile attachment gives the leak limiter an additional degree of freedom so that it is easier to adapt its position with respect to the anode stem. This additional degree of freedom is particularly useful when the anode stem passage opening (17) is relatively large as compared to the stem's cross-section and such an additional degree of freedom enables large stem movements when the stem is being put into place and/or used.

This degree of freedom is also useful when the shape of the opening (17) is more complicated than a simple crenel or notch and the insertion of the anode stem (3) in the opening (17) involves displacements in two directions, i.e. in other words, in the longitudinal and transverse directions with respect to a main axis of the cell as illustrated for example in FIG. 10. In this case, the leak limiter typically has an open position (FIG. 10(*a*)) and a closed position (FIG. 10(*b*)). The leak limiter (20) then advantageously comprises one or more complementary closing elements (33, 34) such as a plate, to maintain the leak tightness of the limiter during displacement thereof. These complementary elements may be fixed or mobile. The mobile leak limiter (20) may possibly cooperate with one or more fixed closing elements (20') to keep the device leak tight when it is displaced. Displacements of the leak limiter may advantageously be guided by a guide element (35) such as a rail.

When the leak limiter (20) contains metallic elements such as a metallic support or metallic wires, particularly if they are close to the anode stem, it is preferable to electrically insulate the leak limiter from the electrolytic cell to avoid short circuits when the anode is being manipulated. This insulation may be obtained by inserting an electrical insulator (27, 28, 28') between the leak limiter and the electrolytic cell. For example, in an embodiment illustrated for example in FIG. 8, the leak limiter (20) is insulated from the cell (1) using an insulating plate (27) inserted between the support (21) and the confinement means (15), and using a tube (28) and a washer (28') inserted between the attachment means (29) and the confinement means (15). This arrangement is advantageous since the insulator is preferably located underneath the support (21), and hence there is little strain on the material. Since the insulator is fixed and not free to move, it is thus not susceptible to mechanical constraints that can cause breakage. Due to the simplicity of the instant invention, sufficient resistance can be achieved with a device that is sufficiently rugged to withstand the conditions of use.

The simplicity of the leak tightness mechanism of a leak limiter according to the present invention means that the present leak limiter generally has sufficient resistance to ambient conditions, and particularly the presence of alumina or crushed bath dust that could block or jam mechanisms containing pivot or rotation pins.

Another advantage of a leak limiter according to the present invention is that the instant leak limiter can typically easily be contained in a small volume. The total thickness of a limiter according to the present invention is typically not more than about 3 to about 4 cm, so that it can be easily positioned between the anode frame (5) and the hood (15).

Another advantage of the invention is that it generally does not require any manual intervention or special actuator, which simplifies its use and increases its reliability.

LIST OF REFERENCE NUMERALS

1 Electrolytic cell
2 Anodes
3 Attachment and current input means (stem)
4 Attachment and current input means (multipode)
5 Anode frame
6 Means for connecting the stem onto the anode frame
7 Pot shell
8 Inside lining
9 Cathode assembly
10 Pot
11 Electrolyte bath
12 Liquid aluminum
13 Metallic structure
14 Confinement means (removable hood)
15 Confinement means (fixed hood)
16 Confined internal space
17 Anode stem passage opening
18 Inside edge of the anode stem passage opening
20 Leak limiter
20' Complementary closing element
21, 21' Leak limiter support
23 Elongated opening
24 Support inside periphery
25 Connecting element
26 Limiter opening
27 Electrical insulator (plate)
28 Electrical insulator (tube)
28' Electrical insulator (washer)
29 Bolt and nut
30*a*, 30*b*, 30*c*, 30' Flexible sealing body
31 Mobile frame/sealing body assembly
32 Frame
33, 34 Complementary closing element
35 Guide means Additional advantages, features and modifications will readily occur to those in the art. Therefore, the invention in its broader aspects is not limited to the details, and representative devices, shown and described herein. Accordingly, modifications may be made without departing from the spirit or scope of the inventive concept as defined by the appended claims and their equivalents.

All documents referred to herein are specifically incorporated herein by reference in their entireties.

As used herein and in the following claims, articles such as "the", "a" and "an" can connote the singular or plural.

We claim:

1. A leak limiter of an electrolytic cell suitable for the production of aluminum, said cell having a fixed structure with at least one passage opening suitable for insertion of an anode stem, wherein the leak limiter comprises:

at least one support configured to be mounted to the fixed structure around an inner periphery of the passage opening and capable of surrounding at least a portion of the anode stem such that the anode stem is laterally moveable with respect to the support, the support comprising an opening through which the anode stem can be inserted laterally; and at least one flexible sealing body mounted to the support and arranged around at least a portion of a periphery of the support, such that at least a portion of the passage opening between an inside edge thereof and the anode stem is closed off.

2. A leak limiter according to claim 1, wherein the flexible sealing body comprises at least one wire, strip, spongy substance and/or flexible tube.

3. A leak limiter according to claim 1, wherein the flexible sealing body comprises at least one bundle of metallic wires and/or at least one bundle of non-metallic wires.

4. A leak limiter according to claim 3, wherein the bundle of metallic wires comprises stainless steel wires.

5. A leak limiter according to claim 1, wherein the at least one flexible sealing body is fixed to at least one frame connected to the support, which is movable with respect to the support.

6. A leak limiter according to claim 5, further comprising at least one connecting element between the support and the frame, whereby displacement of the sealing body is controlled with respect to the support.

7. A leak limiter according to claim 6 wherein the connecting element comprises an elastic element.

8. A leak limiter according to claim 5, wherein the support partially enfolds the frame and the sealing body.

9. A leak limiter according to claim 5, wherein the flexible sealing body and the frame consist essentially of non-magnetic materials.

10. A leak limiter according to claim 9, further comprising at least one connecting element between the support and the frame, such that displacement of the sealing body is controlled with respect to the support.

11. A leak limiter according to claim 10, wherein the connecting element comprises an elastic element.

12. A leak limiter according to claim 1, further comprising at least one electrical insulator in contact with the support and configured to be positioned between the support and the fixed structure.

13. A leak limiter according to claim 5, wherein the support comprises upper and lower portions and said frame is located therebetween.

14. A leak limiter of an electrolytic cell suitable for the production of aluminum, said cell having at least one passage opening suitable for insertion of an anode stem, wherein the leak limiter comprises:

at least one support that is configured to be positioned around the passage opening and capable of surrounding at least a portion of the anode stem, an electrical insulator in contact with said support, and at least one non-magnetic flexible sealing body comprising at least one bundle of stainless steel wires arranged around at least a portion of a periphery of the support and fixed to at least one aluminum or aluminum alloy frame which is connected to the support and movable with respect to the support, such that at least a portion of the passage opening is closed off.

15. A leak limiter of an electrolytic cell suitable for the production of aluminum said cell having at least one passage opening suitable for insertion of an anode stem, wherein the leak limiter comprises:

at least one support comprising a periphery and capable of surrounding at least a portion of the anode stem, wherein the support comprises an opening through which the anode stem can be inserted laterally, a frame connected to the support by at least one connecting element between the support and the frame, wherein the at least one connecting element permits the frame to be moveable with respect to the support, and at least one flexible sealing body fixed to the frame and arranged around at least a portion of the periphery of the support.

16. A leak limiter according to claim 15, wherein the flexible sealing body comprises at least one wire, strip, spongy substance and/or flexible tube.

17. A leak limiter according to claim 15, wherein the flexible sealing body comprises at least one bundle of metallic wires and/or at least one bundle of non-metallic wires.

18. A leak limiter according to claim 17, wherein the bundle of metallic wires comprises stainless steel wires.

19. A leak limiter according to claim 15, wherein the frame is laterally moveable with respect to the support.

20. A leak limiter according to claim 15, wherein the at least one connecting element controls displacement of the sealing body with respect to the support.

21. A leak limiter according to claim 20, wherein the connecting element comprises an elastic element.

22. A leak limiter according to claim 20, comprising two parallel connecting elements.

23. A leak limiter according to claim 21, wherein the elastic element is a spring.

24. A leak limiter according to claim 21, wherein the support enfolds a portion of the frame and the sealing body.

25. A leak limiter according to claim 15, wherein the flexible sealing body and the frame consist essentially of non-magnetic materials.

26. A leak limiter according to claim 25, wherein the at least one connecting element controls displacement of the sealing body with respect to the support.

27. A leak limiter according to claim 26, wherein the connecting element is an elastic element.

28. A leak limiter according to claim 15, further comprising at least one electrical insulator.

29. A leak limiter according to claim 28, wherein the support comprises different elements.

30. A leak limiter according to claim 15, wherein the leak limiter comprises a single frame.

31. A leak limiter of an electrolytic cell suitable for the production of aluminum, said cell having at least one passage opening suitable for insertion of an anode stem, wherein the leak limiter comprises:

at least one support capable of surrounding at least a portion of the anode stem such that the anode stem is moveable vertically and laterally within the support, the support having an internal periphery configured to confront the anode stem; and at least one flexible sealing body arranged around at least a portion of the internal periphery of the support, the flexible sealing body projecting inwardly from the internal periphery of the support and configured to be adjacent to the anode stem, such that the flexible sealing body is flexible to allow the anode stem to move laterally within the support by the anode stem abutting and flexing the flexible sealing body, wherein the flexible sealing body comprises at least one element selected from a group consisting of: a wire, a strip, a spongy substance and/or a flexible tube.

32. A leak limiter according to claim 31, wherein the at least one flexible sealing body is fixed to at least one frame connected to the support by at least one connecting element, such that the frame is movable with respect to the support.

33. A leak limiter according to claim 31, wherein the flexible sealing body comprises a plurality of stainless steel wires arranged around at least a portion of a periphery of the support, each wire projecting inwardly from the internal periphery of the support.

* * * * *